United States Patent [19]

Saulgeot

[11] Patent Number: 4,588,361

[45] Date of Patent: May 13, 1986

[54] HIGH VACUUM ROTARY PUMP

[75] Inventor: Claude Saulgeot, Veyrier-du-Lac, France

[73] Assignee: Compagnie Industrielle des Telecommunications Cit-Alcatel, Paris, France

[21] Appl. No.: 751,908

[22] Filed: Jul. 5, 1985

[30] Foreign Application Priority Data

Jul. 5, 1984 [FR] France ..... 84 10681

[51] Int. Cl.[4] ..... F04B 17/00; F01D 1/36; F16J 15/40

[52] U.S. Cl. ..... 417/424; 414/90; 277/3; 384/478; 417/366

[58] Field of Search ..... 277/3, 53, 55, 56; 384/134, 478; 415/90; 417/424, 366

[56] References Cited

U.S. PATENT DOCUMENTS

| | | | |
|---|---|---|---|
| 2,670,898 | 3/1954 | Pickels . | |
| 3,327,938 | 6/1967 | Stallmann . | |
| 3,347,604 | 10/1967 | Lavelle et al. | 384/134 |
| 3,399,827 | 9/1968 | Schwartzman | 415/90 X |
| 3,832,084 | 8/1974 | Maurice | 415/90 |
| 4,180,370 | 12/1979 | Klalt et al. | 415/90 |
| 4,332,522 | 6/1982 | Saulgeot | 415/90 |
| 4,512,725 | 4/1985 | Saulgeot | 417/424 X |

FOREIGN PATENT DOCUMENTS

| | | | |
|---|---|---|---|
| 0086460 | 8/1983 | European Pat. Off. . | |
| 2359456 | 6/1975 | Fed. Rep. of Germany | 415/90 |
| 2408256 | 9/1975 | Fed. Rep. of Germany . | |
| 2527174 | 12/1976 | Fed. Rep. of Germany . | |
| 868124 | 9/1981 | U.S.S.R. | 415/90 |

*Primary Examiner*—Carlton R. Croyle
*Assistant Examiner*—Theodore W. Olds
*Attorney, Agent, or Firm*—Sughrue, Mion, Zinn, Macpeak & Seas

[57] ABSTRACT

A high vacuum rotary pump comprising a rotor (3) mounted in a stator (1) having a suction end (5) and an exhaust end, the exhaust end being pierced by an exhaust orifice (6) intended for connection to the suction end of a primary pump, said rotor being drivable coupled to a motor (8, 10) housed in a sleeve (11), said sleeve extending the exhaust end of said stator and having the same internal pressure as the exhaust end of the stator, the rotating members of said motor and rotor being supported by bearings (12, 13), and the far end of the sleeve from its end adjacent to the stator being closed by an end plate (14), the pump including the improvement whereby an orifice (16) for rapidly returning the stator to atmospheric pressure is provided in said sleeve in such a manner as to avoid oil vapor being introduced into the stator from the primary pump when the pump is stopped, said orifice being provided with a valve which is closed during operation of the pump and which is open only when the pump is stopped.

2 Claims, 1 Drawing Figure

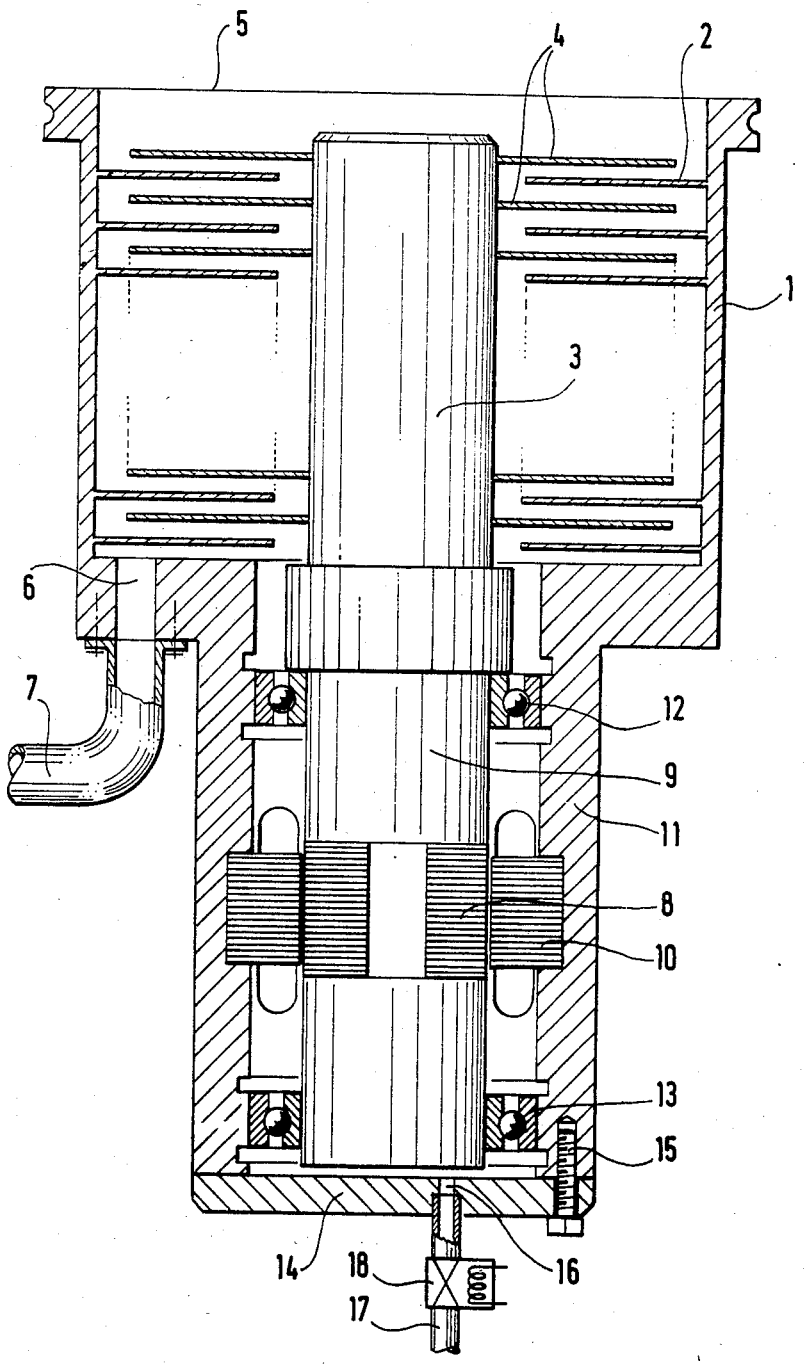
5
4
2
1
3
6
7
12
9
11
8
10
13
15
14
18
16
17

HIGH VACUUM ROTARY PUMP

The present invention relates to a high vacuum rotary pump and in particular to a molecular or a turbomolecular pump including a rotor turning at high speed within a fixed stator.

BACKGROUND OF THE INVENTION

In a conventional pump of this type, the rotor is rotated by a motor which is located in a sleeve extending the exhaust end of the stator, and it thus operates at the exhaust pressure, i.e. at a primary vacuum of about $10^{-2}$ Torr, for example. The entire moving assembly is supported by bearings which likewise operate in a vacuum. Bearings may be provided at either end of the motor inside the sleeve, or else they may be provided in the suction head, with a magnetic bearing in the stator and a bearing in the sleeve beyond the motor. The exhaust end of the stator includes an exhaust pipe connected to a primary pump. At its end furthest from the stator, the sleeve is closed by an end plate.

In general, when the pump assembly (i.e. the primary pump and the turbomolecular pump) is stopped, the pump stator is returned to atmospheric pressure in order to avoid oil in the primary pump from saturating the rotor atmosphere. In order to do this, one known disposition consists in having a pipe connected to the exhaust duct, which pipe is open to the atmosphere and is fitted with an electromagnetic valve which is automatically opened when the pump assembly is stopped.

However, when the gas being pumped from the chamber connected to the suction end of the turbomolecular pump is laden with solid particles, dust, etc., these particles accumulate in the bottom of the stator around the exhaust outlet in such a manner that when the pump is stopped and returned to atmospheric pressure by the above-mentioned pipe, the dust is violently displaced and dust particles become lodged, inter alia, in the sleeve which extends the stator, and in particular in the bearings, e.g. in all bearings which are lubricated with oil or grease. As a result, the bearings wear quickly and need changing frequently.

SUMMARY OF THE INVENTION

Preferred embodiments of the present invention mitigate this drawback and provide a high vacuum rotary pump comprising a rotor mounted in a stator having a suction end and an exhaust end, the exhaust end being pierced by an exhaust orifice intended for connection to the suction end of a primary pump, said rotor being drivable coupled to a motor housed in a sleeve, said sleeve extending from the exhaust end of said stator and having the same internal pressure as the exhaust end of the stator, the rotating members of said motor and rotor being supported by bearings, and the far end of the sleeve from its end adjacent to the stator being closed by an end plate. The pump includes the improvement whereby an orifice for rapidly returning the stator to atmospheric pressure is provided in said sleeve in such a manner as to avoid oil vapor being introduced into the stator from the primary pump when the pump is stopped, said orifice being provided with a valve which is closed during operation of the pump and which is open only when the pump is stopped.

According to a preferred embodiment of the invention, said orifice for returning to atmospheric pressure is provided in said end plate.

BRIEF DESCRIPTION OF THE DRAWING

An embodiment of the invention is described by way of example with reference to the sole FIGURE of the accompanying drawing, which FIGURE is an axial section through a rotary turbomolecular pump.

MORE DETAILED DESCRIPTION

The pump shown in the FIGURE comprises a stator 1 having fixed blades 2 and a rotor 3 having moving blades 4. In operation, the rotor rotates at high speed inside the stator. The stator 1 has a suction end 5 for connection to a chamber to be evacuated, and an exhaust end which includes an exhaust orifice 6 for connection via a duct 7 to the suction end of a primary pump (not shown), e.g. an oil-sealed vane pump.

The rotor 3 is rotated by a motor. The motor is an electric motor comprising a rotor 8 mounted on a shaft 9 which extends from the pump rotor 3, together with a stator 10 mounted in a sleeve 11 which extends the exhaust end of the pump stator 1. The moving equipment (i.e. the pump rotor 3 and the drive motor rotor 8) rotates between ball-bearings 12 and 13 mounted in the sleeve 11. The far end of the sleeve 11 from the turbomolecular pump is closed by an end plate 14 which is fixed to the sleeve by screws such as 15. Thus, in operation, the pressure to be found in the sleeve 11 is the same as the pressure which exists at the exhaust end of the pump, i.e. at its exhaust orifice 6. This pressure may be $10^{-2}$ Torr, for example.

In accordance with the invention, the end plate 14 is pierced by an orifice 16 for returning the stator 1 to atmospheric pressure. This orifice is large enough to ensure that atmospheric pressure is rapidly re-established inside the stator 1, thereby preventing oil vapor from the primary pump polluting the turbomolecular pump. For example, the diameter of the orifice may be greater than 2 mm.

Naturally, while the pump is in operation, the orifice 16 is closed. To this end, it is fitted with a duct 17 leading to the atmosphere and closable by means of an electromagnetic valve 18.

The electromagnetic valve 18 is controlled in such a manner as to open when the pump is stopped and to close when the pump is started.

When the pump is stopped, the valve 18 opens and a flow of gas sweeps through the exhaust end of the pump towards the suction orifice, thereby preventing any solid or corrosive particles which may have accumulated around the exhaust outlet from penetrating into the sleeve 11.

Instead of being provided through the end plate 14, the orifice 16 could be provided through the sleeve 11 anywhere between the end plate 14 and the ball-bearing 12 at the pump end of the motor. However, it is generally more practical to provide the orifice 16 through the closure plate.

I claim:

1. In a high vacuum rotary pump comprising; a pump rotor rotatably mounted in a pump stator, said stator having a suction end and an exhaust end, said exhaust end being pierced by an exhaust orifice for connection to the suction end of a primary pump, a sleeve extending from the exhaust end of said stator and having the same internal pressure as the exhaust end of the stator, a motor housed in said sleeve, said motor including a motor rotor, said pump rotor being drivably coupled to said motor rotor, said rotors of said motor and pump being supported by bearings, and the far end of the sleeve from its end adjacent to the pump stator being closed by an end plate, the improvement comprising: an orifice within one of said sleeve and said end plate for rapidly returning the stator to atmospheric pressure so as to avoid oil vapor being introduced into the stator from the primary pump when the pump is stopped, said orifice including a valve responsive to pump operation to close during operation of the pump and to open only when the pump is stopped.

2. A rotary pump according to claim 1, wherein said orifice for returning to atmospheric pressure is provided in said end plate.

* * * * *